US005394998A

United States Patent [19]

Hanes et al.

[11] Patent Number: 5,394,998

[45] Date of Patent: Mar. 7, 1995

[54] FRONT DRAFT STOP FOR USE IN A DRAWBAR ASSEMBLY

[75] Inventors: Douglas M. Hanes; Jeffrey D. Wurzer, both of Pittsburgh; Peter S. Mautino, Verona, all of Pa.

[73] Assignee: McConway & Torley Corporation, Pittsburgh, Pa.

[21] Appl. No.: 149,054

[22] Filed: Nov. 8, 1993

[51] Int. Cl.[6] ..... B61G 7/00

[52] U.S. Cl. ..... 213/50.5; 213/50

[58] Field of Search ..... 213/50, 50.5, 56, 58, 213/60, 67 R, 67 A, 68, 69, 70, 71, 72

[56] References Cited

U.S. PATENT DOCUMENTS

| | | | |
|---|---|---|---|
| 1,877,335 | 9/1932 | Lounsbury | 213/50 |
| 1,925,998 | 9/1933 | Barrows | 213/50 |
| 1,955,675 | 4/1934 | Glaenzer et al. | 213/50 |
| 4,078,669 | 3/1978 | Peterson et al. | 213/50.5 |
| 4,422,557 | 12/1983 | Altherr | 213/62 R |
| 4,445,617 | 5/1984 | Elliott | 213/50 |
| 4,456,133 | 6/1984 | Altherr et al. | 213/62 R |
| 4,549,666 | 10/1985 | Altherr et al. | 213/62 A |
| 4,580,686 | 4/1986 | Elliott | 213/62 A |
| 4,593,827 | 6/1986 | Altherr | 213/50 |
| 4,681,040 | 7/1987 | Brodeur et al. | 105/3 |
| 4,863,045 | 9/1989 | Altherr | 213/78 |
| 4,966,291 | 10/1990 | Glover | 213/71 |
| 5,002,192 | 3/1991 | Kaufhold | 213/61 |
| 5,097,973 | 3/1992 | Spencer | 213/50 |
| 5,312,007 | 5/1994 | Kaufhold et al. | 213/50 |

FOREIGN PATENT DOCUMENTS

| | | | |
|---|---|---|---|
| 0594689 | 6/1959 | Italy | 213/61 |

*Primary Examiner*—Mark T. Le
*Attorney, Agent, or Firm*—James Ray & Associates

[57] ABSTRACT

A draft stop member in a car coupling arrangement includes a rectangular block-like member. An arcuate portion extends forward from the rear face and inward from the stop upper surface and terminates before a longitudinal centerline thereof. Another arcuate portion extends forward from the rear face and inward from the stop bottom surface and terminates before such centerline. A triangular block-like member formed integral with an inner portion of the rectangular member includes another arcuate portion beginning inward from the stop upper surface and terminating before the centerline. Another arcuate portion begins inward from the stop bottom surface and terminates before the centerline. A nose member formed integral with an inner portion of the triangular member includes an arcuately shaped end disposed axially opposed to the rear face of the rectangular member. A tapered upper surface extends inward toward such rear face from one end of the arcuately shaped end and upward from the centerline. A bottom tapered surface extends inward toward the rear face from another end of the arcuately shaped end and outwardly from the centerline. An upper arcuately shaped portion is disposed between one end of the tapered upper surface and a point inward from the stop upper surface. A bottom arcuately shaped portion begins at one end of the bottom tapered surface and ends inward from the stop bottom surface. An elongated draft key slot receiving member is disposed on an outer surface of such stop about the centerline and an elongated slot formed in the stop about the centerline for receiving a draft key.

19 Claims, 3 Drawing Sheets

FRONT DRAFT STOP FOR USE IN A DRAWBAR ASSEMBLY

FIELD OF THE INVENTION

The present invention relates, in general, to front draft stop members used in a slackless drawbar assembly for connecting adjacent predetermined ends of a pair of railway cars together, in a substantially semipermanent manner, and, more particularly, this invention relates to front draft stop members which are formed as an integral single piece draft stop member for use in such slackless drawbar assembly.

CROSS REFERENCE TO RELATED APPLICATIONS

This patent application is closely related to a patent application No. 08/148,379, titled "YOKE CASTING FOR A DRAWBAR ASSEMBLY" and a patent application No. 08/148,357, titled "RAILWAY CAR SLACKLESS DRAWBAR ASSEMBLY", each of these patent applications is being filed concurrently herewith and they are assigned to the same assignee. Further, each of these patent applications is incorporated herein by reference thereto.

BACKGROUND OF THE INVENTION

It is well known, in the railroad industry, that railway cars can be connected together by different types of coupler members. Such couplers may be conventional couplers, articulated couplers or drawbars. Conventional couplers are independent units disposed on an end of each car which interconnect with one another, between the ends of adjacent cars, to form a connection. Conventional couplers are used on cars which generally require frequent disconnections. Drawbar assemblies are integral units which extend between the ends of two adjacent cars to form a generally semipermanent connection therebetween. In either instance, however, a shank end of the coupler or drawbar will extend into the center sill portion of a railway car where it is secured so as to transmit the longitudinal forces exerted to the car during in track service. Additionally, each type coupler system requires the use of front draft stops to enable draft loads to be safely applied to the end of the railway car.

Certain prior inventions have been directed to improvements in the center sill construction for receiving primarily conventional couplers. However, these improvements may also have application in receiving couplers in a slackless drawbar arrangement. By slackless, it is meant that the drawbar (or coupler) is received within the center sill member in a manner to minimize longitudinal play or movements. However, because it is important for successive railway cars in a train to be able to accommodate relative movement between cars when curves and inclines are to be negotiated, there must be provision made for each car to move in pitch, yaw and roll modes with respect to the coupler member. Furthermore, there must be some provision made to periodically remove the worn and/or broken draft components for repair and/or replacement of parts and, in connection with the slackless drawbar systems, to disconnect adjacently connected railway cars.

In a slackless drawbar system, for example,the coupler member is usually held in a way to eliminate, or at least minimize, the longitudinal movement with respect to the railway car body. This is usually accomplished by providing a tapered wedge member between a rear wall of a pocket casting (secured in the center sill) and a follower block member which rests against the butt end of the coupler member. The tapered wedge member tends to force the follower block member away from the pocket casting end wall and firmly against the butt end of the drawbar member shank. When the cars are being pushed, during operation, the longitudinal forces exerted will cause compression of the drawbar member against the follower block member, tapered wedge member and pocket casting end wall.

Conversely, when the railway cars are being pulled, the longitudinal forces being exerted which tend to separate the drawbar from the pocket casting are countered in some slackless drawbar systems by a draft key which is a metal bar that extends laterally of the car center sill member through slots provided in the sidewalls of the center sill member and a slot formed in the shank of the coupler member and in other slackless drawbar systems through slots which are formed through the front draft stop members.

In such slackless drawbar system, the drawbar is held tightly between the bearing block member and the follower block member by operation of the tapered wedge member which separates the pocket casting and follower block member and compresses the follower block member against the drawbar to force the latter against the bearing block member and the follower block member. However, the mating surfaces of the follower block member and drawbar are, preferably, curved to permit the drawbar to pivot slightly both a vertically and a lateral direction and to permit the railway car to roll with respect to the drawbar.

SUMMARY OF THE INVENTION

The present invention provides an integral single piece front draft stop member for use in a railway car coupling arrangement. Such integral single piece front draft stop member includes a generally rectangular shaped block-like member. The generally rectangular shaped block-like member has a vertically disposed substantially flat rear face portion which is engageable with a vertically disposed substantially flat surface of a predetermined coupling component. A first arcuately shaped portion extends forwardly from such vertically disposed rear face portion for a first predetermined distance. This first arcuately shaped portion begins inwardly a second predetermined distance from an upper surface of the front draft stop member and terminates at a third predetermined distance which is short of a longitudinal centerline of the front draft stop member. There is a second arcuately shaped portion extending forwardly from such vertically disposed rear face portion for the same first predetermined distance. Further, such second arcuately shaped portion begins inwardly for the same second predetermined distance from a bottom surface of such front draft stop member and terminates at the same third predetermined distance short of such longitudinal centerline of the front draft stop member. The front draft stop member also includes a generally triangular shaped block-like member formed integrally with such generally rectangular shaped block-like member adjacent an inner portion thereof. This generally triangular shaped block-like member having a third arcuately shaped portion beginning inwardly for the same second predetermined distance from the upper surface of such front draft stop member and terminating at the same third predetermined distance short of such longitudinal centerline of the front draft stop member. There is a fourth arcuately shaped portion beginning inwardly for the same second predetermined distance from the bottom surface of such front draft stop member and terminating at the same third predetermined distance short of the longitudinal centerline of such front draft stop member. The front draft stop has a nose member formed integrally with such generally triangular shaped block-like member adjacent an inner portion thereof. The nose member includes an arcuately shaped end portion disposed axially opposite such rear face portion of such generally rectangular shaped block-like member. The nose member also includes a tapered upper surface which extends inwardly toward the rear face portion from a first end of such arcuately shaped end and upwardly from the longitudinal centerline of such front draft stop member. Such nose member further includes a bottom tapered surface extending inwardly toward the rear face portion from a second end of such arcuately shaped end and outwardly from the longitudinal centerline of such front draft stop member. There is an upper arcuately shaped portion disposed between one end of the tapered upper surface and a point beginning at the same second predetermined distance from such upper surface of the front draft stop member, and a bottom arcuately shaped portion beginning at one end of such bottom tapered surface which ends at the same second predetermined distance from a bottom surface of such front draft stop member. An elongated draft key slot receiving member is disposed on an outer surface of such front stop member substantially about the longitudinal centerline. The final essential element of the front draft stop member is an elongated slot formed through such front draft stop member substantially about the longitudinal centerline for receiving a draft key therein.

OBJECTS OF THE INVENTION

It is, therefore, one of the primary objects of the present invention is to provide a front draft stop member which is strong and relatively light weight.

Another object of the present invention is to provide a front draft stop member which does not require lightener holes to achieve a minimum weight.

Still another object of the present invention is to provide a front draft stop member which can be retrofitted into an existing coupling arrangement or into a slackless drawbar system.

Yet another object of the present invention is to provide a front draft stop member which is relatively simple to manufacture.

A further object of the present invention is to provide a front draft stop member which requires a minimum amount of maintenance.

An additional object of the present invention is to provide a front draft stop member which is less complex to cast.

In addition to the various objects and advantages of the front draft stop member discussed above, it should be understood that various other objects and advantages of the present invention will become more readily apparent to those persons who are skilled in the railway coupling art from the following more detailed description, particularly, when such description is taken in conjunction with the attached drawings Figures and with the appended claims.

DESCRIPTION OF THE PREFERRED EMBODIMENTS OF THE INVENTION

Figure 1:
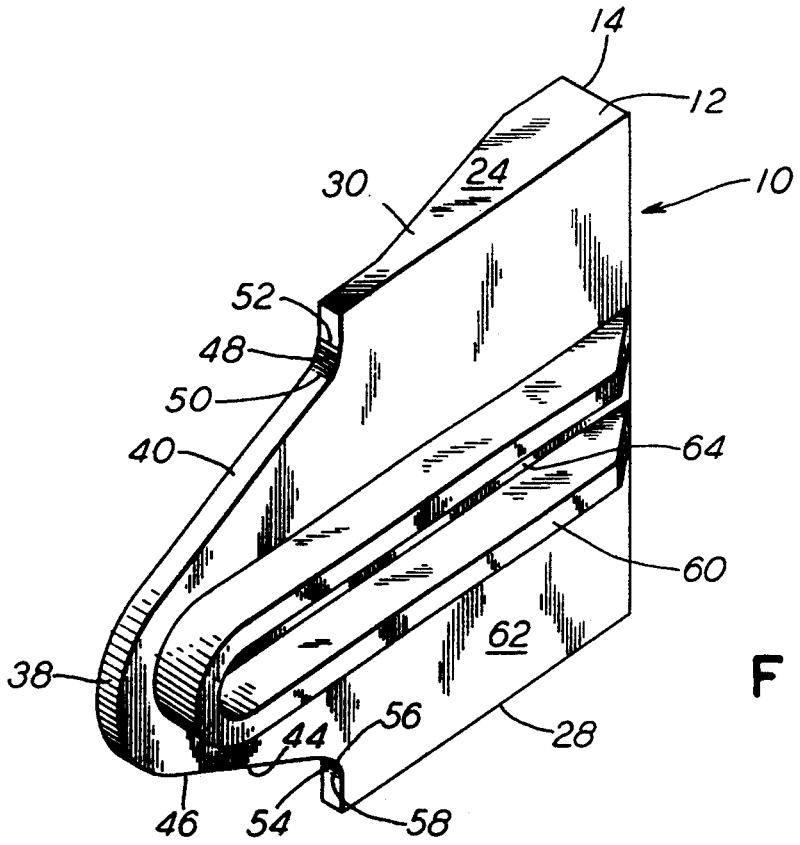
FIG. 1 is a perspective view :showing the presently preferred front draft stop member with a draft key slot.

Prior to proceeding to the more detailed description of the instant invention, it should be noted that for the sake of clarity, identical components, having identical functions, have been designated with identical reference numerals throughout the several drawing Figures.

Figure 2:
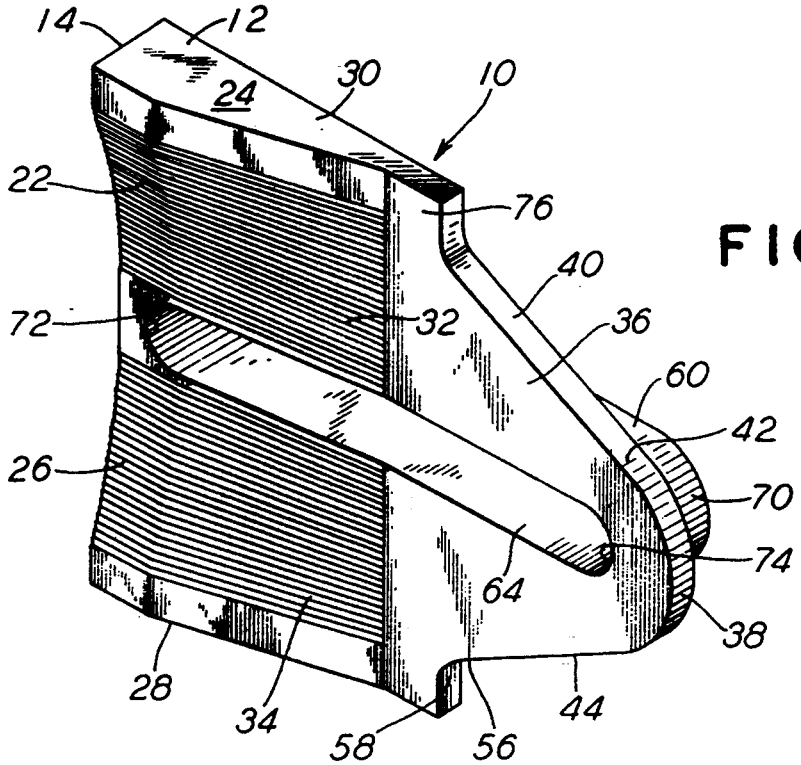
FIG. 2 is a perspective view looking at the inner surface of the front draft stop member illustrated in FIG. 1.
Figure 3:
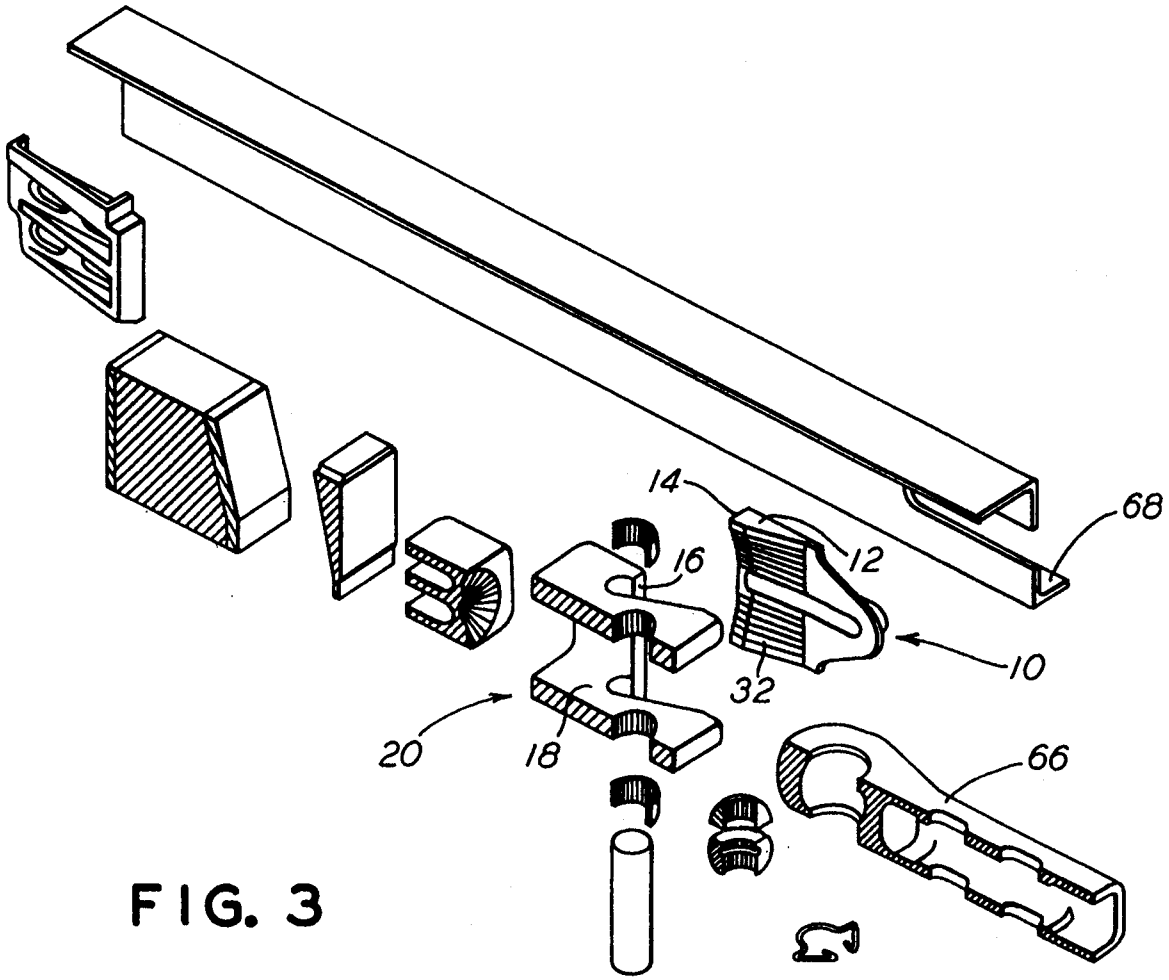
FIG. 3 is an exploded view partially in cross-section which illustrates the use of the front draft stop member in one presently preferred slackless drawbar assembly.
Figure 4:
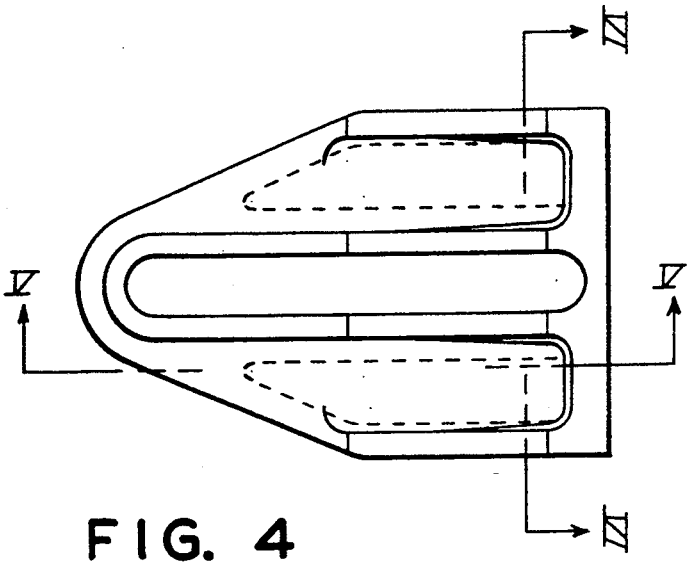
FIG. 4 PRIOR ART
FIG. 4 is a plan view illustrating an outer surface of a prior art front draft stop member.
Figure 5:
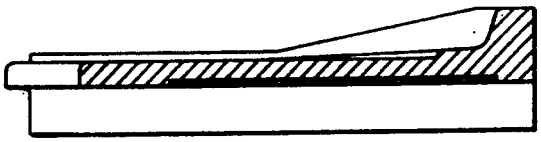
FIG. 5 PRIOR ART
FIG. 5 is a view partially in cross-section taken along lines IV—IV of the prior art front draft stop member, illustrated in FIG. 3.
Figure 6:
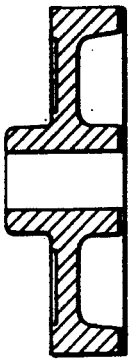
FIG. 6 PRIOR ART
FIG. 6 is a cross-sectional view taken along lines V—V of the prior art front draft stop member.

Now refer more particular to FIGS. 1 through 3. Illustrated therein is an integral single piece front draft stop member, generally designated, 10 which is manufactured according to the present invention. A front draft stop member 10 is utilized in railway car coupling arrangements which connect adjacent ends of railway cars together.

The front draft stop member 10 of the present invention includes a generally rectangular shaped block-like member 12. Such rectangular block-like member 12 has a vertically disposed substantially flat rear face portion 14. The rear face portion 14 is engageable with a vertically disposed substantially flat surface 16 (FIG. 3) of a predetermined coupling component 18, which in the presently preferred embodiment is a yoke, generally designated as 20. A first arcuately shaped portion 22 extends inwardly from the vertically disposed rear face portion 14 of the rectangular block-like member 12 for a first predetermined distance. Such first arcuate portion 22 begins inwardly a second predetermined distance from an upper surface 24 of the front draft stop member 10 and terminates a third predetermined distance which is short of a longitudinal centerline of the front draft stop member 10. A second arcuately shaped portion 26 extends forwardly from such vertically disposed rear face portion 14 of such block-like member 12 for such first predetermined distance. This second arcuate portion 26 begins inwardly from a bottom surface 28 of the front draft stop member 10 substantially the same distance the first arcuate portion 22 extends inwardly from the upper surface 24 of front draft stop member 10. Second arcuate portion 26 terminates short of such longitudinal centerline of the front draft stop member 10 at substantially the same distance such first arcuate portion 22 is short of the longitudinal centerline.

Front draft stop member 10 also includes a generally triangular shaped block-like member 30. Such triangular block-like member 30 is formed integrally with such rectangular block-like member 12 adjacent an inner portion thereof. The triangular block-like member 30 includes a third arcuately shaped portion 32 which extends substantially across a longitudinal face thereof. Further, the third arcuate portion 32 begins inwardly from the upper surface 24 of the front draft stop member 10 at substantially the same point where such first arcuate portion 22 begins. The third arcuate portion 32 terminates short of the longitudinal centerline of the front draft stop member 10 substantially the same distance such first arcuate portion 22 terminates. The triangular block-like member 30 has a fourth arcuate shaped portion 34 which begins inwardly from the bottom surface 28 of the front draft stop member 10 and terminates short of such longitudinal centerline of front draft stop member 10 substantially the same distance such second arcuate portion of block-like member 12 begins inwardly and terminates, respectively.

A nose member 36 is formed integrally with the triangular block-like member 30 adjacent an inner portion thereof. Such nose member 36 includes an arcuately shaped end portion 38 disposed axially opposite the rear face portion 14 of the rectangular block-like member 12. A tapered upper surface 40 extends inwardly toward the rear face portion 14 from a first end 42 of the arcuately shaped end 38 and upwardly from the longitudinal centerline of the front draft stop member 10. Nose portion 36 has a tapered bottom surface 44 which extends inwardly toward such rear face portion 14 of rectangular block-like member 12 from a second end 46 of the arcuately shaped end 38 and outwardly from the longitudinal centerline of front draft stop member 10. An upper arcuately shaped portion 48 is disposed between one end 50 of the tapered upper surface 40 and a point 52 beginning a predetermined distance from the upper surface 24 of front draft stop member 10. Finally, nose portion 36 has a bottom arcuately shaped portion 54 which begins at the end 56 of the bottom tapered surface 44 and ends at a point 58 spaced inwardly from a bottom surface 28 of front draft stop member 10.

An elongated draft key slot receiving member 60 is disposed on an outer surface 62 of such front draft stop member 10 substantially along the longitudinal centerline.

The final essential element of front draft stop member 10 is an elongated slot 64, having a predetermined length, formed through such front draft stop member 10 substantially along the longitudinal centerline. Such slot 64 receives a draft key (not shown) therein. Such draft key providing the connection between the drawbar 66 (FIG. 3) and the center sill member 68 (FIG. 3).

According to a presently preferred embodiment of the invention, the front draft stop member 10 is an integral single piece casting, as opposed to prior art front draft stop members which have been either fabricated, machined or a combination of fabrication and machining. Preferably, the front draft stop member 10 is manufactured as an integral single piece steel casting.

In the preferred front draft; stop member 10, such first arcuately shaped portion 22 and the second arcuately shaped portion 26 disposed on the rectangular shaped block-like member 12 will be substantially identical. In addition, the third arcuately shaped portion 32 and the fourth arcuately shaped portion 34 disposed on the triangular shaped block-like member 30 will be substantially identical.

The tapered upper surface 40 disposed on the nose portion 36 is, preferably, tapered at an angle which is substantially identical to an angle of the taper of such bottom tapered surface 44. Also, the upper arcuately shaped portion 48 disposed on the nose portion 36 will be substantially identical to the bottom arcuately shaped portion 54.

The elongated draft key slot receiving member 60, preferably, includes an arcuately shaped end portion 70 at least adjacent one end thereof. Most preferably, such elongated draft key slot member 60 is substantially U-shaped. In this preferred embodiment, the elongated slot 64 is formed through a portion of the rectangular shaped block-like member 12. The triangular shaped block-like member 30 and a portion of such nose member 36 and has an arcuately shaped portion adjacent each end 72 and 74 thereof.

Nose member 36, preferably, includes a generally rectangular portion 76 extending between an outer portion of the triangular shaped block-like member 30 and such upper and bottom arcuately shaped portions 48 and 54, respectively.

Although a number of presently preferred embodiments of the front draft stop members have been described in detail above, it should be understood that various other modifications and adaptations of the instant invention may be made by persons skilled in the railroad coupling art without departing from the spirit and scope of the appended claims.

We claim:

1. An integral single piece front draft stop member for use in a railway car coupling arrangement, said integral single piece front draft stop member comprising:

(a) a generally rectangular shaped block-like member, said generally rectangular shaped block-like member having;

(i) a vertically disposed substantially flat rear face portion engageable with a vertically disposed substantially flat surface of a predetermined coupling component, (ii) a first arcuately shaped portion extending forwardly from said vertically disposed rear face portion for a first predetermined distance, said first arcuately shaped portion beginning inwardly a second predetermined distance from an upper surface of said front draft stop member and terminating a third predetermined distance short of a longitudinal centerline of said front draft stop member, (iii) a second arcuately shaped portion extending forwardly from said vertically disposed rear face portion for said first predetermined distance, said second arcuately shaped portion beginning inwardly for said second predetermined distance from a bottom surface of said front draft stop member and terminating at said third predetermined distance short of said longitudinal centerline of said front draft stop member;

(b) a generally triangular shaped block-like member formed integrally with said generally rectangular shaped block-like member adjacent an inner portion thereof, said generally triangular shaped block-like member having;

(i) a third arcuately shaped portion beginning inwardly for said second predetermined distance from said upper surface of said front draft stop member and terminating at said third predetermined distance short of said longitudinal centerline of said front draft stop member, and (ii) a fourth arcuately shaped portion beginning inwardly for said second predetermined distance from said bottom surface of said front draft stop member and terminating at said third predetermined distance short of said longitudinal centerline of said front draft stop member;

(c) a nose member formed integrally with said generally triangular shaped block-like member adjacent an inner portion thereof, said nose member having;

(i) an arcuately shaped end portion disposed axially opposed to said rear face portion of said generally rectangular shaped block-like member, (ii) a tapered upper surface extending inwardly toward said rear face portion from a first end of said arcuately shaped end and upwardly from said longitudinal centerline of said front draft stop member, (iii) a tapered bottom surface extending inwardly toward said rear face portion from a second end of said arcuately shaped end and outwardly from said longitudinal centerline of said front draft stop member, (iv) an upper arcuately shaped portion disposed between one end of said tapered upper surface and a point beginning at said second predetermined distance from said upper surface of said front draft stop member, and (v) a bottom arcuately shaped portion beginning at one end of said bottom tapered surface and ending at said second predetermined distance from a bottom surface of said front draft stop member;

(d) an elongated draft key slot receiving member disposed on an outer surface of said front draft stop member substantially along said longitudinal centerline; and (e) an elongated slot formed through said front draft stop member substantially along said longitudinal centerline for receiving a draft key therein.

2. An integral single piece front draft stop member, according to claim 1, wherein said front draft stop member is a single piece casting.

3. An integral single piece front draft stop member, according to claim 2, wherein said single piece casting is a steel casting.

4. An integral single piece front draft stop member, according to claim 1; wherein said first arcuately shaped portion disposed on said generally rectangular shaped block-like member is substantially identical to said second arcuately shaped portion disposed on said generally rectangular shaped block-like member.

5. An integral single piece front draft stop member, according to claim 4, wherein said third arcuately shaped portion disposed on said generally triangular shaped member is substantially identical to said fourth arcuately shaped portion disposed on said generally triangular shaped member.

6. An integral single piece front draft stop member, according to claim 5, wherein a taper of said tapered upper surface disposed on said nose portion is tapered at an angle substantially identical to an angle of a taper of said bottom tapered surface disposed on said nose portion.

7. An integral single piece front draft stop member, according to claim 6, wherein said upper arcuately shaped portion disposed on said nose portion is substantially identical to said bottom arcuately shaped portion disposed on said nose portion.

8. An integral single piece front draft stop member, according to claim 1, wherein said elongated draft key slot receiving member includes an arcuately shaped end portion at least adjacent one end thereof.

9. An integral single piece front draft stop member, according to claim 8, wherein said elongated draft key slot receiving member is substantially U-shaped.

10. An integral single piece front draft stop member, according to claim 9, wherein said elongated slot formed through a portion of said generally rectangular shaped block-like member, said generally triangular shaped block-like member, and a portion of said nose member includes an arcuately shaped portion adjacent each end thereof.

11. An integral single piece front draft stop member, according to claim 1, wherein said nose member includes a generally rectangular portion extending between an outer portion of said generally triangular shaped block-like member and said upper and said bottom arcuately shaped portions.

12. An integral single piece front draft stop member, according to claim 3, wherein said first arcuately shaped portion disposed on said generally rectangular shaped block-like member is substantially identical to said second arcuately shaped portion disposed on said generally rectangular shaped block-like member.

13. An integral single piece front draft stop member, according to claim 12, wherein said third arcuately shaped portion disposed on said generally triangular shaped portion is substantially identical to said fourth arcuately shaped portion disposed on said generally triangular shaped portion.

14. An integral single piece front draft stop member, according to claim 13, wherein a taper of said tapered upper surface disposed on said nose portion is tapered at an angle substantially identical to an angle of a taper of said bottom tapered surface disposed on said nose portion.

15. An integral single piece front draft stop member, according to claim 14, wherein said upper arcuately shaped portion disposed on said nose portion is substantially identical to said bottom arcuately shaped portion disposed on said nose portion.

16. An integral single piece front draft stop member, according to claim 15, wherein said elongated draft key slot receiving member includes an arcuately shaped end portion at least adjacent one end thereof.

17. An integral single piece front draft stop member, according to claim 16, wherein said elongated draft key slot receiving member is substantially U-shaped.

18. An integral single piece front draft stop member, according to claim 17, wherein said elongated slot formed through a portion of said generally rectangular shaped block-like member, said generally triangular-shaped block-like member, and a portion of said nose member includes an arcuately shaped portion adjacent each end thereof.

19. An integral single piece front draft stop member, according to claim 18, wherein said nose member includes a generally rectangular portion extending between an outer portion of said generally triangular shaped block-like member and said upper and said bottom arcuately shaped portions.

* * * * *

UNITED STATES PATENT AND TRADEMARK OFFICE

CERTIFICATE OF CORRECTION

PATENT NO. : 5,394,998

DATED : March 7, 1995

INVENTOR(S) : Douglas M. Hanes et al.

It is certified that error appears in the above-indentified patent and that said Letters Patent is hereby corrected as shown below:

Column 5, line 54, after draft delete ";"

Column 7, line 43, delete ";" and insert --,--

Column 8, line 54, after triangular, please delete the hyphen

Signed and Sealed this

Second Day of May, 1995

*Attest:*

*Attesting Officer*

BRUCE LEHMAN

*Commissioner of Patents and Trademarks*